US006397651B2

(12) United States Patent
Usui et al.

(10) Patent No.: US 6,397,651 B2
(45) Date of Patent: Jun. 4, 2002

(54) DIE ASSEMBLY AND METHOD OF MANUFACTURING DIE ASSEMBLY

(75) Inventors: Toshiyuki Usui; Tohru Uchida, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/789,502

(22) Filed: Feb. 22, 2001

(30) Foreign Application Priority Data

| | | |
|---|---|---|
| Feb. 22, 2000 | (JP) | 2000-043714 |
| Feb. 22, 2000 | (JP) | 2000-043715 |
| Feb. 22, 2000 | (JP) | 2000-043716 |
| Feb. 22, 2000 | (JP) | 2000-043717 |

(51) Int. Cl.[7] ..... B21D 37/01

(52) U.S. Cl. ..... 72/294; 72/335; 72/462; 76/104.1; 76/107.1; 76/116; 219/76.16; 219/121.47; 219/121.59; 83/694

(58) Field of Search ..... 72/324, 326, 294, 72/335, 332, 462, 476, 319, 483, 467; 29/402.18; 76/107.1, 104.1, 108.1, 116, DIG. 5; 219/76.16, 121.47, 121.59, 76.15; 83/694; 30/350

(56) References Cited

U.S. PATENT DOCUMENTS

| | | | | |
|---|---|---|---|---|
| 2,478,171 A | * | 8/1949 | Macpherson | 76/107.1 |
| 2,494,970 A | * | 1/1950 | Shea | 76/107.1 |
| 3,234,774 A | * | 2/1966 | Margedant | 72/294 |
| 4,864,094 A | * | 9/1989 | Saltzman et al. | 219/76.16 |
| 5,230,756 A | * | 7/1993 | Kawasaki et al. | 219/121.59 |
| 6,297,466 B1 | * | 10/2001 | Hussary et al. | 219/121.47 |

FOREIGN PATENT DOCUMENTS

| | | |
|---|---|---|
| JP | A584591 | 4/1993 |
| JP | A5195121 | 8/1993 |
| JP | A5208296 | 8/1993 |
| JP | A5237656 | 9/1993 |
| JP | B2-2838657 | 10/1998 |

* cited by examiner

*Primary Examiner*—Daniel C. Crane
(74) *Attorney, Agent, or Firm*—Birch, Stewart, Kolasch & Birch, LLP

(57) ABSTRACT

A cutting edge is formed by build-up welding on a die of a die assembly made of a base material of an aluminum/copper-based zinc alloy. The cutting edge comprises an underlying layer and an overlying layer. The underlying layer is made of a copper alloy that can be welded to both a zinc alloy and a nickel alloy, and the overlying layer is made of a nickel alloy. The cutting edge is of high machinability, high durability, and high hardness.

15 Claims, 7 Drawing Sheets

DIE ASSEMBLY AND METHOD OF MANUFACTURING DIE ASSEMBLY

BACKGROUND OF THE INVENTION

1. Field of the Invention

The present invention relates to a die assembly such as a pressing die assembly for bending a blank to a desired shape or a trimming die assembly for drawing a blank and trimming a peripheral edge thereof, and a method of manufacturing such a die assembly.

2. Description of the Related Art

Automotive bodies are produced by pressing, drawing, and trimming blanks.

Die assemblies for pressing, drawing, and trimming blanks are generally made of cast iron or cast steel, and so rigid that they can withstand several hundred thousand pressing cycles. However, such die assemblies are expensive to manufacture.

Other die assemblies which do not machine blanks, but are relatively inexpensive to manufacture and suitable for manufacturing products of many different types in small quantities are made of base materials of zinc alloy, as disclosed in Japanese laid-open patent publications Nos. 5-84591, 5-195121, 5-208296, and 5-237656.

Specifically, Japanese laid-open patent publication No. 5-84591 discloses that a zinc alloy containing magnesium and aluminum and having a Vickers hardness of 150 or more is welded on a zinc alloy containing aluminum and copper by build-up welding.

Japanese laid-open patent publication No. 5-195121 proposes a zinc alloy for a pressing die assembly, which is made of 9.5–30 wt % of aluminum, 6.0–20 wt % of copper, 0.01–0.2 wt % of magnesium, and the remainder of zinc.

Japanese laid-open patent publication No. 5-237656 shows a method of repairing a die assembly of aluminum by plating only a peripheral region of the die assembly, except for a region to be repaired, with Ni—P, and padding the region to be repaired with a filler metal for thereby achieving desired hardness of the peripheral region.

According to Japanese laid-open patent publication No. 5-208296, it has been proposed to use a zinc alloy as a base material of a die assembly for molding plastics and to use an aluminum alloy containing Si or the like as a filler metal for repairing the die assembly.

Die assemblies made of base materials of zinc alloy are lightweight, easy to cast, and of excellent maintainability. Though zinc alloys have excellent machinability, they are soft. Therefore, a different metal needs to be added to a certain region of zinc alloy if a cutting edge or the like is mounted on the zinc alloy.

Specifically, even if a zinc alloy containing magnesium and aluminum or an aluminum alloy containing Si or the like is welded on a zinc alloy containing aluminum and copper by build-up welding, as disclosed in Japanese laid-open patent publications Nos. 5-84591 and 5-208296, the welded region is not sufficiently hard for use as a trimming blade. The method disclosed in Japanese laid-open patent publication No. 5-237656 fails to achieve a sufficient level of hardness.

Therefore, die assemblies of zinc alloy are actually limited to use as die assemblies for molding plastics.

Japanese laid-open patent publication No. 5-195121 proposes a pressing die assembly, which has a cutting edge that needs to be hard and a bending member that needs to be resistant to wear. However, the problems of the cutting edge and the bending member remain to be solved.

According to other proposals, a cutting edge that needs to be hard is not formed by build-up welding, but a region to serve as a cutting edge is plated with a hard chromium layer or a cutting edge is formed by evaporation, sputtering, or the like. With these proposals, however, it is difficult to form a cutting edge of a thickness required to keep it durable. In addition, these proposed processes are not cost-effective enough.

Furthermore, as disclosed in Japanese patent No. 2838657, a cutting edge is formed by defining a bevel on an edge of a die assembly, welding a filler metal of high hardness on the bevel by build-up welding, and then grinding the filler metal with a grinder. However, it is known in the art that only a Cu-based or Zn-based material can be directly welded to a zinc alloy, but there is no Cu-based or Zn-based material that is hard enough for use as a cutting edge material.

SUMMARY OF THE INVENTION

The weldability of a zinc alloy and a nickel alloy with respect to each other is so poor that the nickel alloy cannot be welded on the zinc alloy to form a highly hard build-up welded region. As a result of studies made by the inventors of the present invention, it has been found that a copper alloy can be welded to both a zinc alloy and a nickel alloy. The present invention resides in that an underlying layer of copper alloy is welded on a base material and an overlying layer of nickel alloy is welded on the underlying layer.

A die assembly according to the present invention comprises an upper die and a lower die for trimming or bending a workpiece, at least one of the upper die and the lower die having a cutting edge or a bending member. The upper die and the lower die being made of a base material of an aluminum/copper-based zinc alloy, the cutting edge or the bending member having a machined build-up welded region comprising an underlying layer made of a filler metal of a copper-based material that can be welded to a zinc alloy and an overlying layer made of a filler metal of a nickel-based material that has a sufficient hardness and can be welded to the underlying layer of the copper-based material.

If the overlying layer is brought into contact with the base material when it is welded on the underlying layer, sputtering occurs, causing a welding defect. It is therefore necessary to weld the overlying layer on the underlying layer out of contact with the base material.

The at least one of the upper die and the lower die may have a bevel on which the cutting edge or the bending member is disposed. The bevel has a vertical dimension which substantially corresponds to the width of one weld pass of weld beads and a horizontal dimension which substantially corresponds to the width of two weld passes of weld beads, and including a flat area in a transversely outer region thereof, the flat area having a width which substantially corresponds to the width of one weld pass of weld beads. With this structure, the underlying layer is prevented from falling, and sputtering and blow holes are prevented from occurring due to contact between the base material and the overlying layer.

For effectively preventing blow holes from occurring, the bevel may have a chamfered surface and an extension extending therefrom. The underlying layer is disposed in covering relation to the bevel in its entirety and made of a copper-based material, and the overlying layer is disposed on the underlying layer out of contact with the base material and made of a nickel-based material. The overlying layer can be welded while a produced gas is being discharged through the underlying layer formed on the extension.

The copper-based material may be pure copper, aluminum bronze, silicon bronze, or the like. For better weldability, silicon bronze is most preferable.

The silicon bronze is preferably composed of 1.0–8.0 wt % of Si, 0.3–4.0 wt % of Mn, 0.03–4.5 wt % of Pb, 0.03–11.0 wt % of Al, 0.03–7.0 wt % of Ni, 0.03–6.0 wt % of Fe, and the remainder of Cu.

Si (silicon) is an element required for deoxidization, and is also an element for increasing hardness. If the amount of Si were less than 1.0 wt %, then deoxidization would be insufficient and blow holes would be liable to occur. If the amount of Si exceeded 8 wt %, then the silicon bronze would not be of a one-phase structure, but many phases would be precipitated, and the structure would become fragile.

Mn (manganese) is an element required for deoxidization and desulfurization. If the amount of Mn were less than 0.3 wt %, then the effect of its addition would not appear. If Mn were added in excess of 4.0 wt %, then no further effect would be achieved.

Pb (lead) is an element for increasing machinability. If the amount of Pb were less than 0.03 wt %, then almost no effect would be obtained from its addition. If the amount of Pb exceeded 4.5 wt %, then it would easily bring about weld cracks.

Al (aluminum) is a colorant. If Al increases, then the silicon bronze changes its color from copper red to gold. Al is also an element for increasing hardness. If the amount of Al were less than 0.03 wt %, then the effect of its addition would not appear. If the amount of Al exceeded 11 wt %, then the hardness and elongation would be lowered.

Ni (nickel) is an element effective to increase hardness. If the amount of Ni were less than 0.03 wt %, then almost no effect would be obtained from its addition. If the amount of Ni exceeded 7.0 wt %, then it would be excessive and the hardness would be lowered.

Fe (iron) is an element for reducing the grain size and increasing hardness. If the amount of Fe were less than 0.03 wt %, then almost no effect would be obtained from its addition. If the amount of Fe exceeded 6.0 wt %, then it would be excessive and no effect would be obtained from its addition.

The nickel-based material of the overlying layer preferably is composed of 1.0–6.0 wt % of B, 5.0–20.0 wt % of Cr, 1.0–7.0 wt % of Si, 0.03–4.0 wt % of Fe, 0.5–6.0 wt % of Cu, and the remainder of Ni.

B (boron) is an element for reducing the grain size and increasing hardness. If the amount of B were less than 1.0 wt %, then the effect of its addition would be extremely small. If the amount of B were in excess of 6.0 wt %, then it would be excessive, tending to produce weld cracks.

Cr (chromium) is an element for increasing hardness and increasing acid resistance at high temperatures. If the amount of Cr were less than 5.0 wt %, then the effect of its addition would be small. If the amount of Cr were in excess of 20.0 wt %, then it would be excessive, lowering the machinability.

Si (silicon) is a deoxidizing element and an element for improving fluidity. If the amount of Si were smaller than 1.0 wt %, then the effect of its addition for fluidity would be small. If the amount of Si were greater than 7.0 wt %, then it would be excessive, tending to produce weld cracks.

Fe (iron) is an element for reducing the grain size and increasing hardness. If the amount of Fe were less than 0.03 wt %, then almost no effect would be obtained from its addition. If the amount of Fe exceeded 4.0 wt %, then it would be excessive and no effect would be obtained from its addition.

Cu (copper) is an element effective for increasing toughness. If the amount of Cu were less than 0.5 wt %, then almost no effect would be obtained from its addition. If the amount of Cu exceeded 6.0 wt %, then it would be excessive, and the toughness would be lowered, tending to cause weld cracks.

For welding the layers on the bevel, a portion of the die along the bevel is preheated, and then an oxide film on the bevel is removed. Thereafter, the underlying layer is welded on the bevel. At least a portion of the die along the underlying layer is preheated, and an oxide film on the underlying layer is removed, after which the overlying layer is welded on the underlying layer. The weldability of the cutting edge is increased by thus preheating the base material in its entirety or a portion thereof where the layers are to be formed by build-up welding, before the layers of copper-based material and nickel-based material are formed by build-up welding.

The bevel is preheated to about 200° C. before the underlying layer is welded on the bevel, and the underlying layer is preheated to about 250° C. before the overlying layer is welded on the underlying layer.

The underlying and overlying layers should preferably be welded by a TIG (tungsten inert gas) welding process because the TIG welding process is less conducive to the generation of blow holes than MIG welding and arc welding processes.

The underlying layer may be welded by an AC TIG welding process. The AC TIG welding process has a cleaning action to remove an oxide film to make the underlying layer smooth. Specifically, the aluminum/copper-based zinc alloy is liable to produce an oxide film thereon which is responsible for a welding failure. According to the AC TIG welding process, a negative pole spot is apt to be formed in an area where an oxide is present on the surface of the base material. The negative pole spot removes the oxide with intensive heat, then moves toward a next oxide, and similarly removes the next oxide.

The AC TIG welding process is also effective to minimize the penetration of the underlying layer into the base material, and prevent a zinc alloy of the base material from rising to or nearly to the surface of the underlying layer, thereby preventing sputtering.

If the underlying layer were welded by the AC TIG welding process, then since the aluminum/copper-based zinc alloy has a low melting point, the base material might be melted before the welding rod is melted, producing a hole and causing a welding failure.

The overlying layer may be welded by a DC TIG welding process. The DC TIG welding process serves to increase the weldability. Specifically, since the underlying layer is made of a copper-based material which is a good heat conductor, the underlying layer does not easily reach its melting point. However, because the DC TIG welding process has a large current capacity and allows the overlying layer to penetrate deeply into the underlying layer, the underlying layer is melted for increased weldability.

Both the AC TIG welding process and the DC TIG welding process should preferably employ a shield gas of helium or a mixture of helium and argon. Since helium is more effective to concentrate heat without spreading it than argon, it is preferable to use a gas of helium or a mixed gas of helium and argon for TIG-welding materials of high heat conductivity, such as zinc alloy. It is preferable to weld the underlying layer according to the AC TIG welding process and to weld the overlying layer according to the DC TIG welding process.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

FIG. 4(*b*) is an enlarged photographic representation (×100) of a portion B in FIG. 4(*a*);

FIG. 4(*c*) is an enlarged photographic representation (×100) of a portion C in FIG. 4(*a*);

DETAILED DESCRIPTION OF THE PREFERRED EMBODIMENTS

Figure 1A:
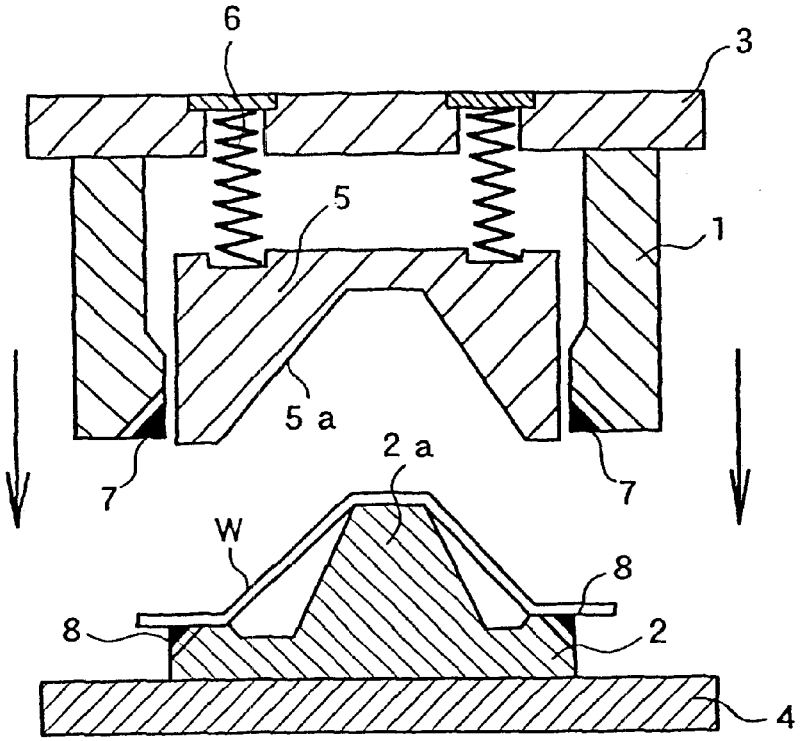
FIGS. 1(*a*) and 1(*b*) are cross-sectional view of a trimming die assembly according to the present invention, showing a process of trimming a workpiece.
Figure 1B:
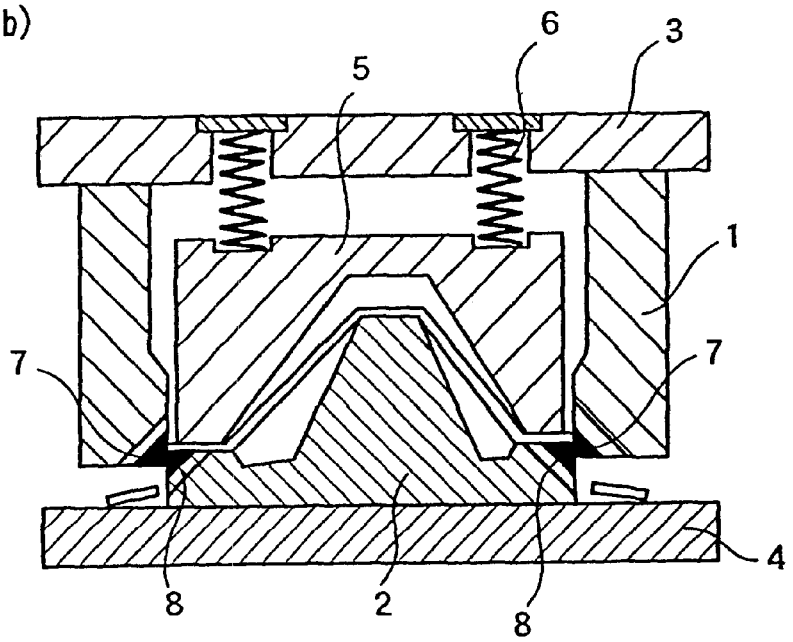

As shown in FIGS. 1(*a*) and 1(*b*), a trimming die assembly comprises an upper die 1 having an upper end attached to a vertically movable plate 3 and a lower die 2 fixedly mounted on a base plate 4. A presser pad 5 is vertically movably supported in the upper die 1, with springs 6 disposed between the presser pad 5 and the vertically movable plate 3.

The presser pad 5 has a forming recess 5*a* defined in a lower surface thereof, and the lower die 2 has a land 2*a* for placing a workpiece W thereon. The upper die 1 has a cutting edge 7 on an inner peripheral edge of the lower end thereof, and the lower die 2 has a cutting edge 8 on an outer peripheral edge of the upper end thereof.

As shown in FIG. 1(*a*), after the workpiece W is placed on the land 2*a* of the lower die 2, the vertically movable plate 3, the upper die 1, and the presser pad 5 are lowered toward the lower die 2. The presser pad 5 has a lower end projecting slightly downwardly from the lower end of the upper die 1. Therefore, before the lower end of the upper die 1 contacts the workpiece W, the presser pad 5 presses a peripheral edge of the workpiece W downwardly against the outer peripheral edge of the upper end of the lower die 2. Continued downward movement of the upper die 1 causes the cutting edges 7, 8 to cut off the peripheral edge of the workpiece W, as shown in FIG. 1(*b*).

Figure 2:
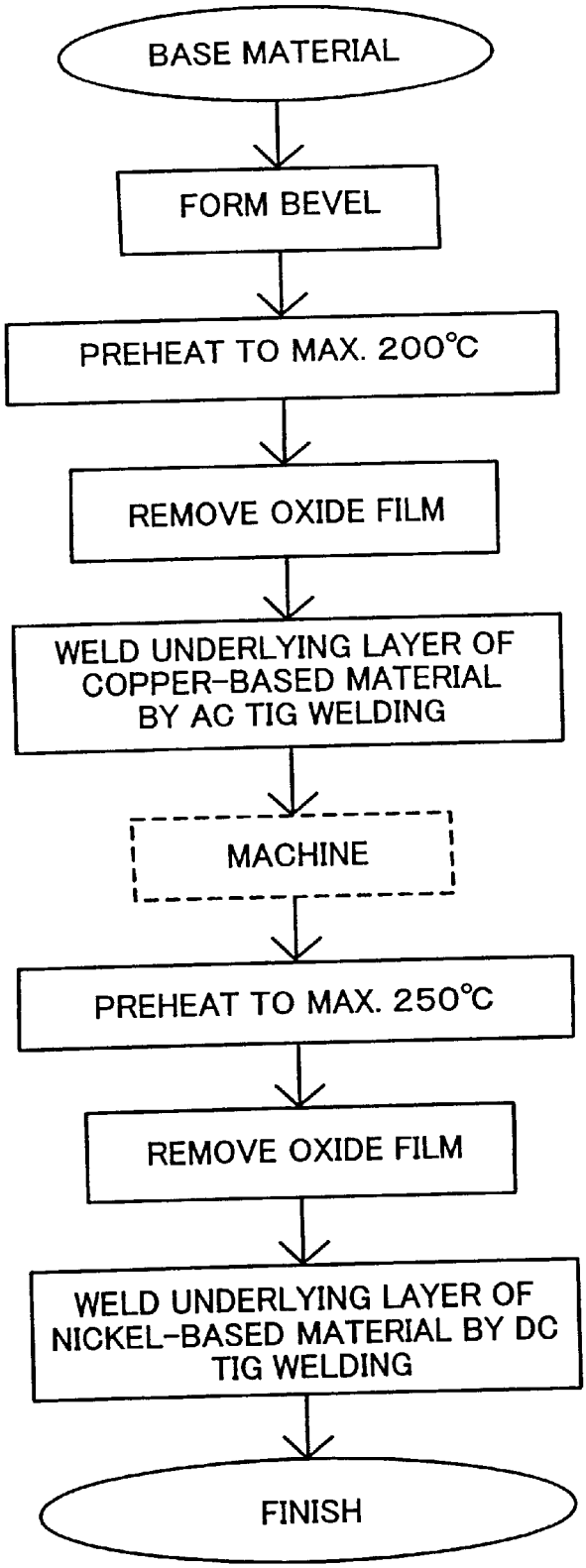
FIG. 2 is a flowchart of a method of manufacturing a die assembly according to the present invention.

A process of forming the cutting edges 7, 8 will be described below with reference to FIGS. 2 and 3(*a*) through 3(*d*). Since the cutting edges 7, 8 are formed in the same manner, only the cutting edge 8 of the lower die 2 will be described below.

Figure 3:
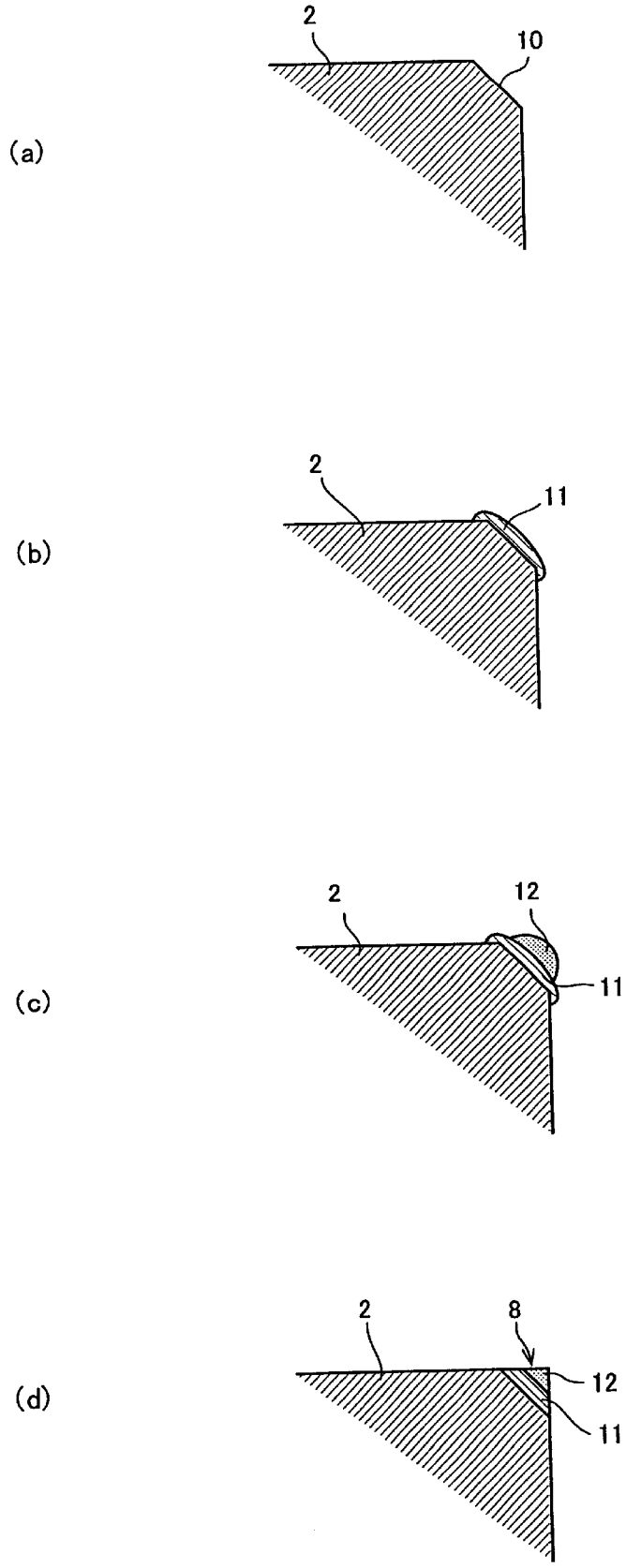
FIGS. 3(*a*) through 3(*d*) are enlarged fragmentary cross-sectional views illustrative of a process of forming a cutting edge of the trimming die assembly.

As shown in FIG. 3(*a*), a bevel 10 is formed on the outer circumferential edge of the upper end of the lower die 2. Then, the bevel 10 is preheated by a burner, or the lower die is preheated in its entirety, at a temperature of about 200° C. If the preheating temperature were lower than 200° C., then a welding failure would occur. If the preheating temperature greatly exceeded 200° C., then the base material of the lower die 2 would be melted. Therefore, the preheating temperature should preferably be in the vicinity of 200° C.

Thereafter, the lower die 2 is machined along the bevel 10 with a grinder or an NC machine tool to remove an oxide film. Then, as shown in FIG. 3(*b*), a underlying layer 11 is formed on the bevel 10 by a TIG welding process. The TIG welding process is an AC (alternating current) TIG welding process performed under the conditions of a shield gas of helium or argon and an alternating current ranging from 120 to 150 amperes.

Figure 4A:
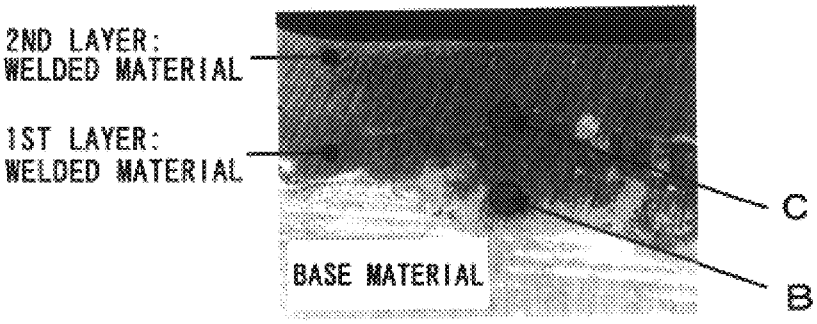
FIG. 4(*a*) is a photographic representation (×1) showing a metal structure of the cutting edge.
Figure 4B:
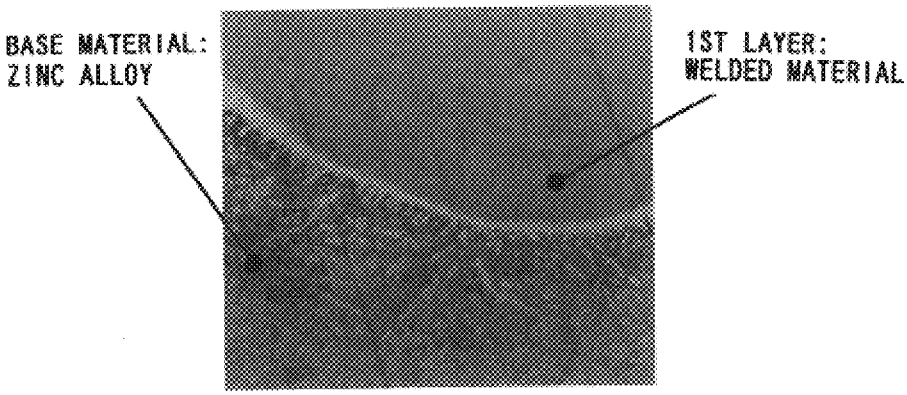
Figure 4C:
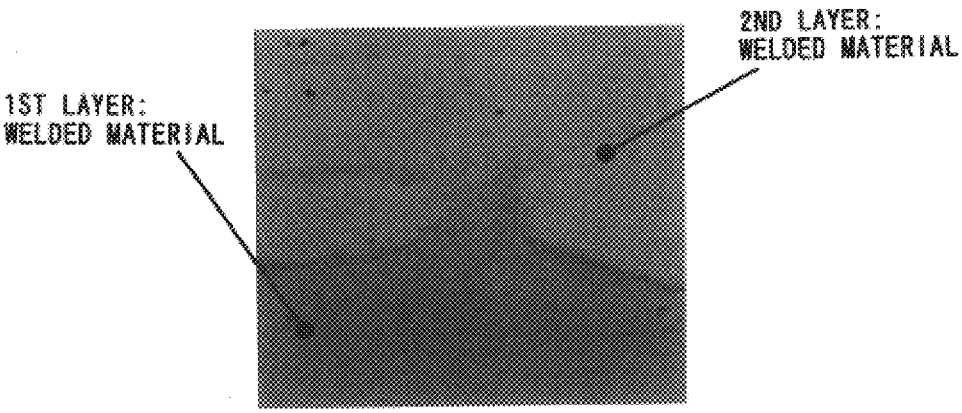

The AC TIG welding process for welding the underlying layer 11 has a cleaning action to remove an oxide film and minimizes the penetration of the underlying layer into the base material, as shown in FIGS. 4(*a*) and 4(*b*). Since the penetration of the underlying layer 11 into the base material is minimized, a zinc alloy of the base material is prevented from rising to or closely to the surface of the underlying layer. If a zinc alloy rose into the underlying layer, then sputtering would be caused when an overlying layer (described later on) is welded.

A filler metal used to weld the underlying layer 11 comprises a copper alloy. In the present embodiment, the copper alloy is composed of 0.84 wt % of Mn (manganese), 3.7 wt % of Si (silicon), and the remainder of Cu (copper).

However, the copper alloy is not limited to the above composition, but should preferably be composed of 1.0–8.0 wt % of Si, 0.3–4.0 wt % of Mn, 0.03–4.5 wt % of Pb (lead), 0.03–11.0 wt % of Al (aluminum), 0.03–7.0 wt % of Ni (nickel), 0.03–6.0 wt % of Fe (iron), and the remainder of Cu.

After the underlying layer 11 has been formed in covering relation to the entire bevel 10, the underlying layer 11, a region extending around the underlying layer 11, and the entire lower die 2 are heated to about 250° C. After an oxide film is removed again using a grinder or an NC machine tool, an overlying layer 12 is formed on the underlying layer 11 out of contact with the base material by a TIG welding process, as shown in FIG. 3(*c*).

The TIG welding process for welding the overlying layer 12 is a DC (direct current) TIG welding process performed under the conditions of a shield gas of helium or argon and a direct current of 130 amperes. A filler metal used to weld the overlying layer 12 comprises a nickel alloy. In the present embodiment, the nickel alloy is composed of 2.3 wt % of B (boron), 3.2 wt % of Si, and the remainder of Ni.

However, the nickel alloy is not limited to the above composition, but should preferably be composed of 1.0–6.0 wt % of B, 5.0–20.0 wt % of Cr (chromium), 1.0–7.0 wt % of Si, 0.03–4.0 wt % of Fe, 0.5–6.0 wt % of Cu, and the remainder of Ni.

A shield gas of helium is preferable for the reasons described above. The DC TIG welding process allows the overlying layer to penetrate deeply into the underlying layer, as shown in FIGS. 4(*a*) and 4(*c*), thus increasing the peeling strength of the cutting edge.

Then, the underlying layer 11 and the overlying layer 12 are machined into the cutting edge 8 by a grinder or an NC machine tool, as shown in FIG. 3(*d*). The cutting edge 8 thus formed is capable of trimming workpieces in several ten thousand cycles.

Figure 5:
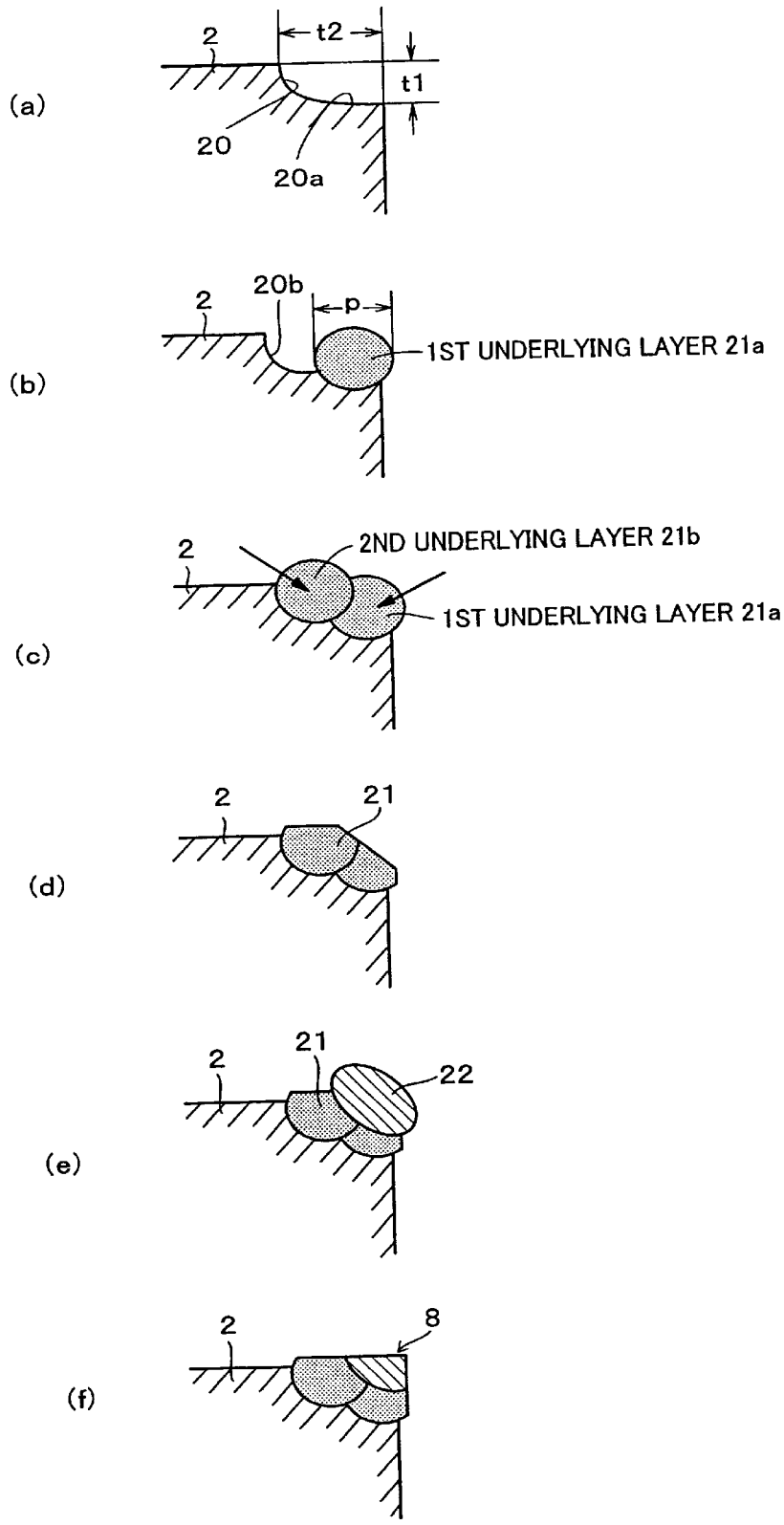
FIGS. 5(*a*) through 5(*f*) are enlarged fragmentary cross-sectional views illustrative of a process of forming a cutting edge according to another embodiment of the present invention.

A process of forming the cutting edge 8 according to another embodiment of the present invention will be described below with reference to FIGS. 5(*a*) through 5(*f*). As shown in FIG. 5(*a*), a bevel 20 formed on the outer circumferential edge of the upper end of the lower die 2 has a vertical dimension t1 which substantially corresponds to the width p of one weld pass of weld beads and a horizontal dimension t2 which substantially corresponds to the width of two weld passes of weld beads. The bevel 20 includes a flat area 20*a* in a transversely outer region thereof, the flat area 20*a* having a width which substantially corresponds to the width of one weld pass of weld beads.

The vertical dimension t1 substantially corresponds to the width of one weld pass p of weld beads because if the vertical dimension t1 were too small, then an underlying layer would fall off the bevel when it is welded, and if the vertical dimension t1 were too large, then the number of welding cycles for forming an underlying layer would be increased, making a subsequent machining process complex. The vertical dimension t1 may not exactly correspond to the width of one weld pass p of weld beads, but may be in the range of the width of one weld pass p±10%.

The horizontal dimension t2 substantially corresponds to the width of two weld passes of weld beads in order to form a gas discharge passage for discharging a gas produced at the time an overlying layer is welded and also to avoid contact between the overlying layer and the base material. If the horizontal dimension t2 were too small, the opening of the gas discharge passage would be of an insufficient size, and if the horizontal dimension t2 were too large, then the number of welding cycles for forming an overlying layer would be increased. The horizontal dimension t2 may not exactly correspond to the width of two weld passes of weld beads, but may be in the range of the width of two weld passes±10%.

The width of the flat area 20*a* substantially corresponds to the width of one weld pass of weld beads in order to form a barrier in welding a first underlying layer, as described later on. The width of the flat area 20*a* may not exactly correspond to the width of one weld pass of weld beads, but may be in the range of the width of one weld pass p±10%.

Then, the bevel 20 is preheated by a burner, or the lower die 2 is preheated in its entirety, at a temperature of about 200° C. If the preheating temperature were lower than 200° C., then a welding failure would occur. If the preheating temperature greatly exceeded 200° C., then the base material of the lower die 2 would be melted. Therefore, the preheating temperature should preferably in the vicinity of 200° C.

Thereafter, the lower die 2 is machined along the bevel 20 with a grinder or an NC machine tool to remove an oxide film. Then, as shown in FIG. 5(*b*), a first underlying layer 21*a* is formed on the flat area 20*a*, and a groove 20*b* is formed in the bevel 20, using the first underlying layer 21*a* as a barrier.

Then, as shown in FIG. 5(*c*), a second underlying layer 21*b* is welded in the groove 20*b*. In the present embodiment, the first and second underlying layers are welded. However, third and fourth underlying layers may additionally be welded depending on the volume of the groove.

The first and second underlying layers 21*a*, 21*b* are welded by an AC TIG welding process performed under the conditions of a shield gas of helium or argon and an alternating current ranging from 120 to 150 amperes. A filler metal used to weld the underlying layers 21*a*, 21*b* comprises a copper alloy which is composed of 0.84 wt % of Mn, 3.7 wt % of Si, and the remainder of Cu (copper).

The AC TIG welding process for welding the first and second underlying layers has a cleaning action to remove an oxide film and minimizes the penetration of the underlying layers into the base material, as shown in FIGS. 4(*a*) and 4(*b*). Since the penetration of the underlying layers into the base material is minimized, a zinc alloy of the base material is prevented from rising to or closely to the surface of the underlying layers. If a zinc alloy rose into the underlying layers, then sputtering would be caused when an overlying layer (described later on) is welded.

While a shield gas of argon can be used, since helium is more effective to concentrate heat without spreading it than argon, it is preferable to use a gas of helium or a mixed gas of helium and argon for TIG-welding materials of high heat conductivity, such as zinc alloy.

The copper alloy is not limited to the above composition, but should preferably be composed of 1.0–8.0 wt % of Si, 0.3–4.0 wt % of Mn, 0.03–4.5 wt % of Pb, 0.03–11.0 wt % of Al, 0.03–7.0 wt % of Ni, 0.03–6.0 wt % of Fe, and the remainder of Cu.

After the underlying layers 21*a*, 21*b* have been formed in covering relation to the entire bevel 20, the thickness of the underlying layers 21*a*, 21*b* (collectively referred to as the underlying layer 21 as shown in FIG. 5(*d*)) is adjusted to about 2 mm by a grinder or an NC machine tool. However, the thickness of the underlying layer 21 may not be adjusted.

The underlying layer 21, a region extending around the underlying layer 21, and the entire lower die 2 are heated to about 250° C. After an oxide film is removed again using a grinder or an NC machine tool, an overlying layer 22 is formed on the underlying layer 21 out of contact with the base material by a TIG welding process, as shown in FIG. 5(*e*).

The overlying layer 22 is formed in overlapping relation to the underlying layer 21, which has an exposed upper surface over the groove 20*b*. The underlying layer 21 is nearly in a melted state due to the heat of the overlying layer 22 when it is welded. When the overlying layer 22 is welded, a gas is produced. The produced gas passes through the underlying layer 21 in the melted state and is discharged from the exposed upper surface of the underlying layer 21.

The TIG welding process for welding the overlying layer 22 is a DC TIG welding process performed under the conditions of a shield gas of helium or argon and a direct current of 130 amperes. A filler metal used to weld the overlying layer 22 comprises a nickel alloy which is composed of 2.3 wt % of B, 3.2 wt % of Si, and the remainder of Ni.

However, the nickel alloy is not limited to the above composition, but should preferably be composed of 1.0–6.0 wt % of B, 5.0–20.0 wt % of Cr, 1.0–7.0 wt % of Si, 0.03–4.0 wt % of Fe, 0.5–6.0 wt % of Cu, and the remainder of Ni.

A shield gas of helium is preferable for the reasons described above. The DC TIG welding process allows the overlying layer to penetrate deeply into the underlying layer, as shown in FIGS. 4(*a*) and 4(*c*), thus increasing the peeling strength of the cutting edge.

After the overlying layer 22 has been formed, it is ground into the cutting edge 8 by a grinder, as shown in FIG. 5(*f*). The cutting edge 8 thus formed has a hardness of 41.1

(HRC) at its tip, a hardness of 37.6 (HRC) at its center, a hardness of 18.9 (HRC) at the boundary between the underlying and overlying layers, and a hardness of 80.9 (HRC) at the boundary between the base material and the underlying layer. When subjected to a striking test using a hammer, no crack was formed in the cutting edge 8.

A process of forming the cutting edge 8 according to still another embodiment of the present invention will be described below with reference to FIGS. 6(*a*) through 6(*d*).

Figure 6:
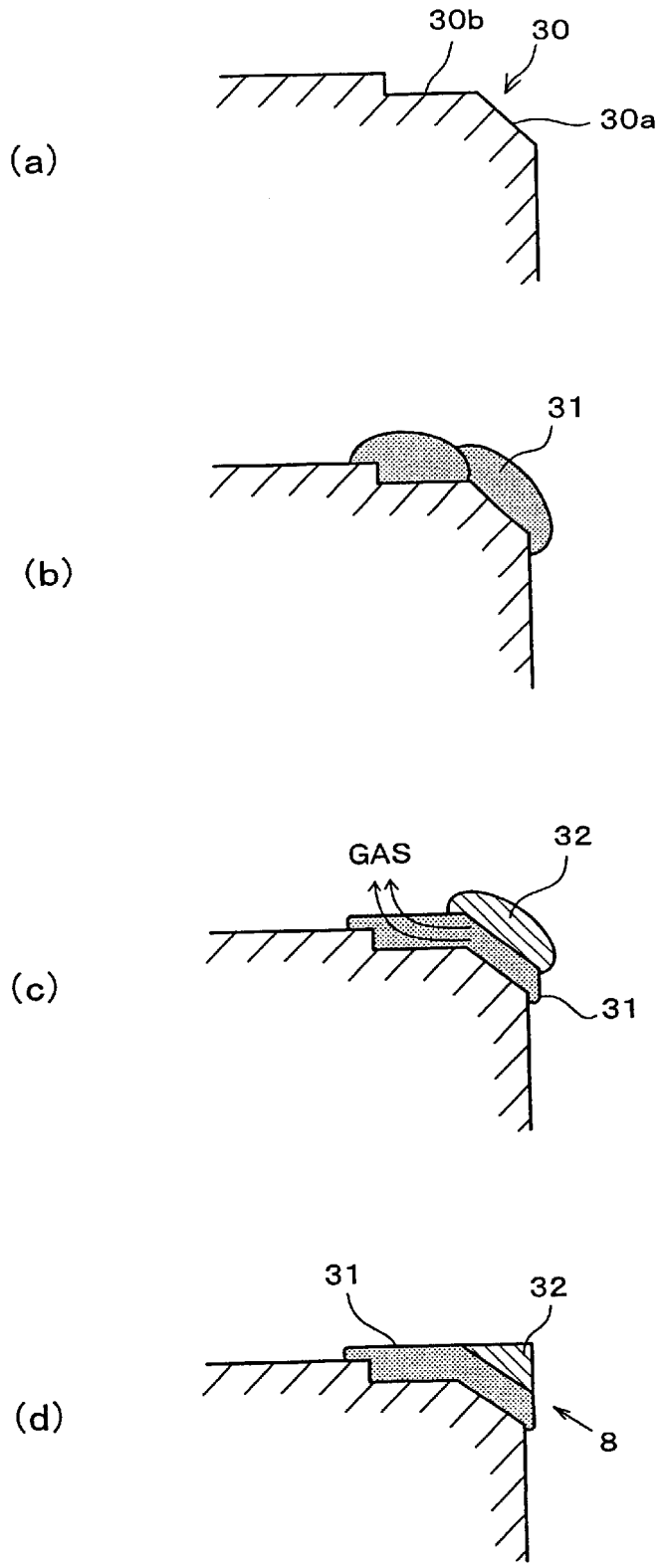
FIGS. 6(*a*) through 6(*d*) are enlarged fragmentary cross-sectional views illustrative of a process of forming a cutting edge according to still another embodiment of the present invention.

As shown in FIG. 6(*a*), a bevel 30 formed on the outer circumferential edge of the upper end of the lower die 2 comprises a chamfered surface 30*a* and an extension 30*b* extending along the upper surface of the lower die. For example, the chamfered surface 30*a* has a length of 5 mm, and the extension 30*b* has a length of 8 mm and a depth of 0.5 mm. The chamfered surface 30*a* may comprise a flat surface or a round surface.

After the bevel 30 has been formed, the lower die 2 is preheated to remove an oxide film. Then, as shown in FIG. 6(*b*), an underlying layer 31 is formed on the bevel 30 by TIG welding under the same conditions as those in the above embodiments.

After the underlying layer 31 has been formed in covering relation to the chamfered surface 30*a* and the extension 30*b*, the thickness of the underlying layer 31 is adjusted to about 2 mm by a grinder or an NC machine tool. The underlying layer 31 and a region extending around the underlying layer 31 are heated to about 250° C. After an oxide film is removed again using a grinder, an overlying layer 32 is formed on the underlying layer 31 a DC TIG welding process under the same conditions as those in the above embodiments, as shown in FIG. 6(*c*).

The underlying layer 31 extends over the extension 30*b*, but the overlying layer 32 does not extend over the extension 30*b*. Therefore, only the underlying layer 31 is disposed on the extension 30*b* and is nearly in a melted state due to the heat of the overlying layer 32 when it is welded. When the overlying layer 32 is welded, a gas is produced. The produced gas passes through the underlying layer 31 in the melted state and is discharged from the underlying layer 21 over the extension 30*b*.

Then, the underlying layer 31 and the overlying layer 32 are machined into the cutting edge 8 by a grinder or an NC machine tool, as shown in FIG. 6(*d*). The cutting edge 8 thus formed is capable of trimming workpieces in several ten thousand cycles.

Figure 7:
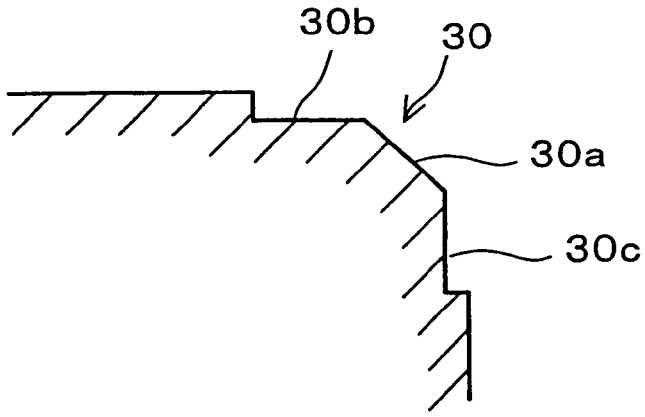
FIG. 7 is a fragmentary cross-sectional view of a bevel according to yet another embodiment of the present invention.

FIG. 7 shows in cross section a bevel 30 according to yet another embodiment of the present invention. In FIG. 7, the bevel 30 comprises a chamfered surface 30*a*, an extension 30*b* extending along the upper surface of the lower die, and an extension 30*c* extending along the vertical surface of the lower die. Since the extensions 30*b*, 30*c* are positioned on opposite sides of the chamfered surface 30*a*, the peeling strength of a resultant cutting edge is further increased.

While the trimming die assembly has been described above, the principles of the present invention are also applicable to a pressing die assembly. In each of the illustrated embodiments, the cutting edge is constructed of two layers formed by build-up welding. The other portion of the die than the cutting edge may be constructed of an underlying layer of copper alloy and an overlying layer of nickel alloy which are formed by build-up welding.

According to the present invention, as described above, since the base material of the die assembly is a zinc alloy, the die assembly has better machinability, electrical-discharge-machinability, and grindability than die assemblies of cast iron, aluminum, and steel, can be manufactured in a greatly reduced period of time, and has excellent repairability and maintenability.

To form the cutting edge or bending member which poses problems when the base material is made of a zinc alloy, a layer of nickel alloy of high hardness is not directly welded on the base material by build-up welding, but an underlying layer of copper alloy is welded on the base material, and then an overlying layer of nickel alloy is welded on the underlying layer. Therefore, the cutting edge or bending member is of sufficiently high hardness.

The bevel for welding a cutting edge thereon by build-up welding may have a vertical dimension which substantially corresponds to the width of one weld pass of weld beads and a horizontal dimension which substantially corresponds to the width of two weld passes of weld beads, and may include a flat area in a transversely outer region thereof, the flat area having a width which substantially corresponds to the width of one weld pass of weld beads. With the bevel thus shaped, even if the base material is made of a zinc alloy and an underlying layer of copper-based material and an overlying layer of nickel-based material are formed by build-up welding, the underlying layer does not fall off when it is welded, and a gas produced when the overlying layer is welded is discharged through the underlying layer. Therefore, welding defects such as blow holes are avoided, and a cutting edge of excellent peeling strength can be formed by build-up welding.

The bevel for welding a cutting edge thereon by build-up welding may have a chamfered surface and an extension extending therefrom. With the bevel thus shaped, even if the base material is made of a zinc alloy and an underlying layer of copper-based material and an overlying layer of nickel-based material are formed by build-up welding, a gas produced when the overlying layer is welded is discharged through the underlying layer. Therefore, welding defects such as blow holes are avoided, and a cutting edge of excellent peeling strength can be formed by build-up welding.

The weldability of the cutting edge is increased by preheating the base material in its entirety or a portion thereof where the layers are to be formed by build-up welding, before the layers of copper-based material and nickel-based material are formed by build-up welding.

If an underlying layer of copper-based material is formed by AC TIG welding and an overlying layer of nickel-based material is formed by DC TIG welding, then a hardened portion of excellent peeling strength can efficiently be formed as a cutting edge.

Although certain preferred embodiments of the present invention have been shown and described in detail, it should be understood that various changes and modifications may be made therein without departing from the scope of the appended claims.

What is claimed is:

1. A die assembly comprising an upper die and a lower die for trimming or bending a workpiece, at least one of said upper die and said lower die having a cutting edge or a bending member, said upper die and said lower die being made of a base material of an aluminum/copper-based zinc alloy, said cutting edge or said bending member having a machined build-up welded region comprising an underlying layer made of a filler metal of a copper-based material and an overlying layer made of a filler metal of a nickel-based material.

2. A die assembly according to claim 1, wherein said at least one of said upper die and said lower die has a bevel on which said cutting edge or said bending member is disposed, said bevel having a vertical dimension which substantially corresponds to the width of one weld pass of weld beads and a horizontal dimension which substantially corresponds to the width of two weld passes of weld beads, and including a flat area in a transversely outer region thereof, said flat area having a width which substantially corresponds to the width of one weld pass of weld beads.

3. A die assembly according to claim 1, wherein said at least one of said upper die and said lower die has a bevel on which said cutting edge or said bending member is disposed, said bevel having a chamfered surface and an extension extending therefrom, said underlying layer being disposed in covering relation to said bevel in its entirety and made of a copper-based material, said overlying layer being disposed on said underlying layer out of contact with said base material and made of a nickel-based material.

4. A die assembly according to claim 1, wherein said copper-based material is silicon bronze.

5. A die assembly according to claim 4, wherein said silicon bronze is composed of 1.0–8.0 wt % of Si, 0.3–4.0 wt % of Mn, 0.03–4.5 wt % of Pb, 0.03–11.0 wt % of Al, 0.03–7.0 wt % of Ni, 0.03–6.0 wt % of Fe, and the remainder of Cu.

6. A die assembly according to claim 4, wherein said nickel-based material is composed of 1.0–6.0 wt % of B, 5.0–20.0 wt % of Cr, 1.0–7.0 wt % of Si, 0.03–4.0 wt % of Fe, 0.5–6.0 wt % of Cu, and the remainder of Ni.

7. A method of manufacturing a die assembly, comprising the steps of:

forming a bevel on an edge of a die which is made of a base material of an aluminum/copper-based zinc alloy;

welding an underlying layer of a copper-based filler metal on said bevel in its entirety by build-up welding; and welding an overlying layer of a nickel-based filler metal on said underlying layer out of contact with said base material.

8. A method according to claim 7, wherein said bevel has a chamfered surface and an extension extending therefrom, said underlying layer is welded on said chamfered surface and said extension with said extension extending along an upper surface of said die, and thereafter said overlying layer is welded on said underlying layer out of contact with said base material while a produced gas is being discharged through the underlying layer on said extension.

9. A method according to claim 7, further comprising the steps of:

preheating at least a portion of said die along said bevel;

then removing an oxide film on said bevel before said underlying layer is welded on said bevel;

preheating at least a portion of said die along said underlying layer; and then removing an oxide film on said underlying layer before said overlying layer is welded on said underlying layer.

10. A method according to claim 7, wherein said underlying layer is welded by an AC TIG welding process, and said overlying layer is welded by a DC TIG welding process.

11. A method according to claim 10, wherein both said AC TIG welding process and said DC TIG welding process employ a shield gas of helium or a mixture of helium and argon.

12. A method according to claim 7, wherein said bevel is preheated to about 200° C. before said underlying layer is welded on said bevel, and said underlying layer is preheated to about 250° C. before said overlying layer is welded on said underlying layer.

13. A method according to claim 7, wherein said copper-based filler metal comprises silicon bronze.

14. A method according to claim 13, wherein said silicon bronze is composed of 1.0–8.0 wt % of Si, 0.3–4.0 wt % of Mn, 0.03–4.5 wt % of Pb, 0.03–11.0 wt % of Al, 0.03–7.0 wt % of Ni, 0.03–6.0 wt % of Fe, and the remainder of Cu.

15. A method according to claim 7, wherein said nickel-based filler metal is composed of 1.0–6.0 wt % of B, 5.0–20.0 wt % of Cr, 1.0–7.0 wt % of Si, 0.03–4.0 wt % of Fe, 0.5–6.0 wt % of Cu, and the remainder of Ni.

* * * * *